US009039006B2

(12) United States Patent
Asakawa

(10) Patent No.: US 9,039,006 B2
(45) Date of Patent: May 26, 2015

(54) SHEET CONVEYANCE APPARATUS AND IMAGE FORMING APPARATUS PROVIDED WITH THE SAME

(71) Applicant: KYOCERA Document Solutions Inc., Osaka-shi, Osaka (JP)

(72) Inventor: Yoshiyuki Asakawa, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/032,058

(22) Filed: Sep. 19, 2013

(65) Prior Publication Data

US 2014/0084532 A1 Mar. 27, 2014

(30) Foreign Application Priority Data

Sep. 21, 2012 (JP) ..... 2012-207900

(51) Int. Cl.

| | |
|---|---|
| ***B65H 5/38*** | (2006.01) |
| ***B65H 3/14*** | (2006.01) |
| ***B65H 5/36*** | (2006.01) |
| ***B65H 3/66*** | (2006.01) |
| ***B65H 1/12*** | (2006.01) |
| ***B65H 1/26*** | (2006.01) |
| ***B65H 3/06*** | (2006.01) |
| ***B65H 3/68*** | (2006.01) |
| ***B65H 5/06*** | (2006.01) |

(52) U.S. Cl.

CPC .. *B65H 3/14* (2013.01); *B65H 5/38* (2013.01); *B65H 5/36* (2013.01); *B65H 3/66* (2013.01); *B65H 1/12* (2013.01); *B65H 1/266* (2013.01); *B65H 3/06* (2013.01); *B65H 3/0669* (2013.01); *B65H 3/68* (2013.01); *B65H 5/062* (2013.01); *B65H 2301/51212* (2013.01); *B65H 2404/1112* (2013.01); *B65H 2404/6111* (2013.01); *B65H 2405/111* (2013.01); *B65H 2406/121* (2013.01); *B65H 2406/412* (2013.01); *B65H 2801/09* (2013.01)

(58) Field of Classification Search

CPC ..... B65H 5/38; B65H 1/04
USPC ..... 271/264, 145, 162, 225, 97
See application file for complete search history.

(56) References Cited

U.S. PATENT DOCUMENTS 7,389,981 B2 * 6/2008 Lee et al. ..... 271/97
2005/0242486 A1 11/2005 Lee et al.

FOREIGN PATENT DOCUMENTS

JP 07172619 A 7/1995
JP 2005314114 A 11/2005

(Continued)

*Primary Examiner* — Luis A Gonzalez
(74) *Attorney, Agent, or Firm* — Alleman Hall McCoy Russell & Tuttle LLP

(57) ABSTRACT

A sheet conveyance apparatus according to one aspect of the present disclosure includes frame, sheet stack portion, sheet stacking plate, feeding portion, conveyance portion, conveyance guide member, blower fan, air duct, and blowing control portion. Feeding portion feeds sheet stacked on sheet stacking plate. Conveyance portion is provided on downstream side in sheet conveyance direction relative to feeding portion. Conveyance guide member is provided on downstream side in sheet conveyance direction relative to feeding portion, and spaced from feeding portion by predetermined gap, and has guide surface to support lower surface of sheet fed by feeding portion and guide sheet downstream in sheet conveyance direction. An end portion of guide surface on upstream side in sheet conveyance direction is positioned lower than feeding position. Air duct blows air sent from blower fan, toward gap, from position lower than the gap. Blowing control portion controls blowing of air from air duct.

17 Claims, 11 Drawing Sheets

(56) References Cited

FOREIGN PATENT DOCUMENTS

| | | | | |
|---|---|---|---|---|
| JP | 2007091431 | A | * | 4/2007 |
| JP | 2008024485 | A | | 2/2008 |
| JP | 2010042910 | A | * | 2/2010 |
| JP | 2010241560 | A | * | 10/2010 |
| JP | 2011006189 | A | * | 1/2011 |

* cited by examiner

SHEET CONVEYANCE APPARATUS AND IMAGE FORMING APPARATUS PROVIDED WITH THE SAME

INCORPORATION BY REFERENCE

This application is based upon and claims the benefit of priority from the corresponding Japanese Patent Application No. 2012-207900 filed on Sep. 21, 2012, the entire contents of which are incorporated herein by reference.

BACKGROUND

The present disclosure relates to a sheet conveyance apparatus including a conveyance guide that supports and guides a sheet fed from a sheet stacking plate by a feeding portion downstream in the feeding direction, and to an image forming apparatus including the sheet conveyance apparatus.

An image forming apparatus such as a facsimile apparatus, a copy machine, a printer, a scanner, or a multifunction peripheral having such functions includes a sheet conveyance apparatus. The sheet conveyance apparatus takes out and conveys, one by one, sheets such as document sheets or print sheets placed on a sheet tray. The sheet conveyance apparatus has a curved conveyance path that guides a sheet to an image forming portion or an image reading position. When a sheet is conveyed to such a curved conveyance path, a sound (contact sound) occurs due to contact of the sheet with a conveyance guide. In order to prevent such occurrence of sound, a mechanism is known in which a blower hole is provided on the conveyance guide forming the conveyance path, and air is blown from the blower hole toward a sheet, thereby stabilizing the orientation of the sheet.

A sound during sheet conveyance occurs not only at a portion where the conveyance path is curved. For example, in the case where there is a height difference between a feeding position of a sheet and the conveyance guide, a sound also occurs when a sheet passes through the height difference portion. In detail, when the rear end portion of the sheet passes through the feeding position, the orientation of the rear end portion of the sheet is changed from the feeding position to the conveyance guide, and the rear end portion of the sheet collides with the conveyance guide, whereby a sound (collision sound) occurs.

SUMMARY

A sheet conveyance apparatus according to one aspect of the present disclosure includes a frame, a sheet stack portion, a sheet stacking plate, a feeding portion, a conveyance portion, a conveyance guide member, a blower fan, an air duct, and a blowing control portion. The sheet stack portion is provided inside the frame and allows a sheet to be stacked in the sheet stack portion. The sheet stacking plate is provided in the sheet stack portion. A sheet can be stacked on the sheet stacking plate. The feeding portion feeds a sheet stacked on the sheet stacking plate from a predetermined feeding position. The conveyance portion is provided on a downstream side in a sheet conveyance direction relative to the feeding portion, and conveys the sheet fed from the feeding portion, further downstream in the sheet conveyance direction. The conveyance guide member is provided on a downstream side in the sheet conveyance direction relative to the feeding portion, and spaced from the feeding portion by a predetermined gap, and has a guide surface to support a lower surface of the sheet fed by the feeding portion and guide the sheet downstream in the sheet conveyance direction. An end portion of the guide surface on an upstream side in the sheet conveyance direction is positioned lower than the feeding position. The blower fan is attached to the frame. The air duct is provided in the sheet stack portion and blows air sent from the blower fan, toward the gap, from a position lower than the gap. The blowing control portion controls blowing of air from the air duct.

An image forming apparatus according to another aspect of the present disclosure includes a frame, a sheet stack portion, a sheet stacking plate, a feeding portion, a conveyance portion, a conveyance guide member, a blower fan, an air duct, and a blowing control portion. The sheet stack portion is provided inside the frame and allows a sheet to be stacked in the sheet stack portion. The sheet stacking plate is provided in the sheet stack portion. A sheet can be stacked on the sheet stacking plate. The feeding portion feeds a sheet stacked on the sheet stacking plate from a predetermined feeding position. The conveyance portion is provided on a downstream side in a sheet conveyance direction relative to the feeding portion, and conveys the sheet fed from the feeding portion, further downstream in the sheet conveyance direction. The conveyance guide member is provided on a downstream side in the sheet conveyance direction relative to the feeding portion, and spaced from the feeding portion by a predetermined gap, and has a guide surface to support a lower surface of the sheet fed by the feeding portion and guide the sheet downstream in the sheet conveyance direction. An end portion of the guide surface on an upstream side in the sheet conveyance direction is positioned lower than the feeding position. The blower fan is attached to the frame. The air duct is provided in the sheet stack portion and blows air sent from the blower fan, toward the gap, from a position lower than the gap. The blowing control portion controls blowing of air from the air duct.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an embodiment of the present disclosure will be described with reference to the drawings. It is noted that the embodiment described below is merely an embodied example of the present disclosure, and the embodiment of the present disclosure can be modified as appropriate within a range not changing the gist of the present disclosure.

Figure 1:
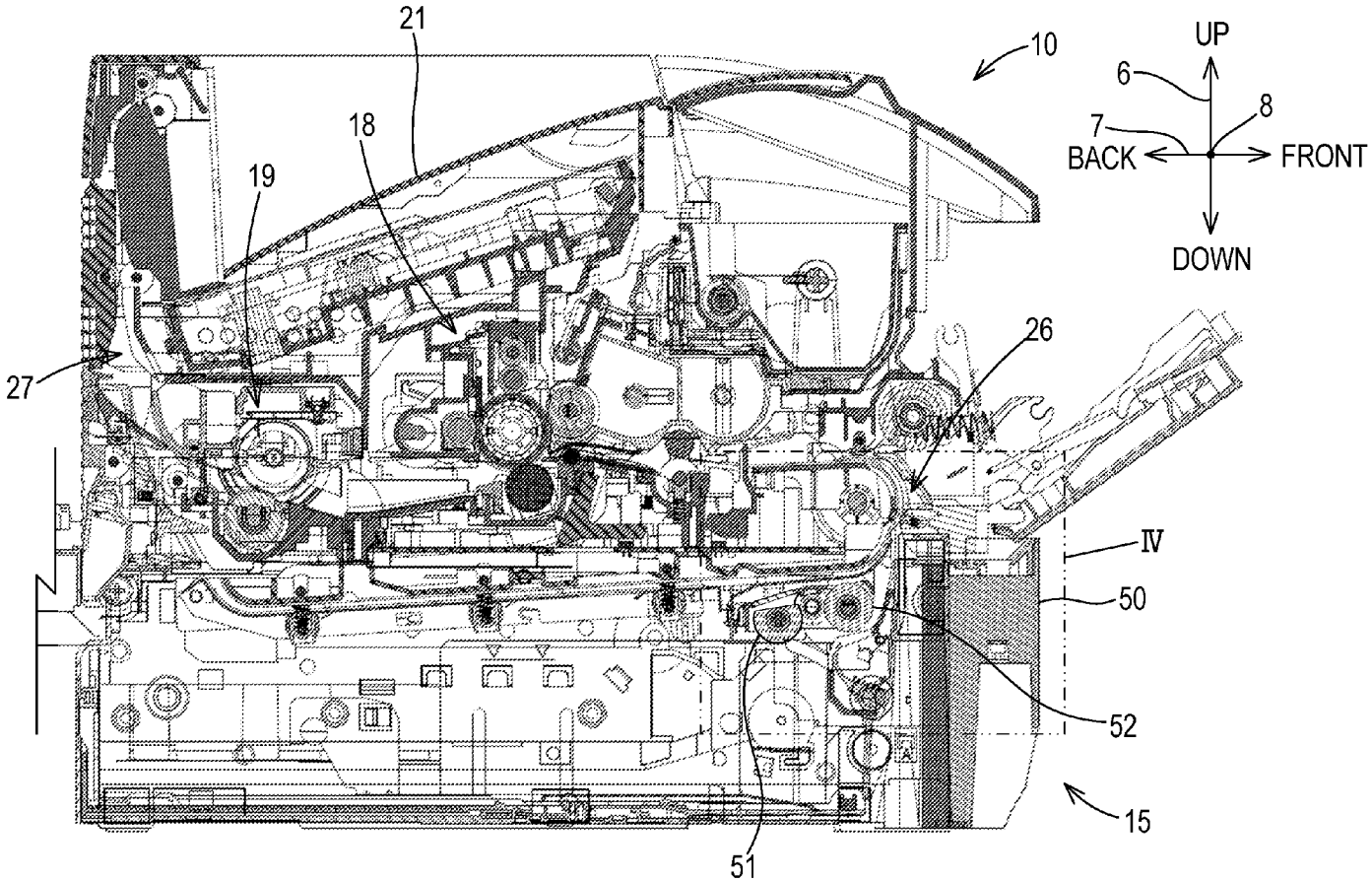
FIG. 1 is a sectional view showing the configuration of a printer according an embodiment of the present disclosure.

A printer 10 shown in FIG. 1 is an example of an image forming apparatus of the present disclosure. In the description shown below, an up-down direction 6 is defined with reference to the state (state in FIG. 1) in which the printer 10 is placed so as to be usable, a front-back direction 7 is defined such that the right side on the drawing of FIG. 1 is the front side, and a right-left direction 8 is defined such that the far side in the direction perpendicular to the drawing of FIG. 1 is the right side and the near side is the left side. It is noted that the present disclosure is not limited to the printer 10, but may be a sheet conveyance apparatus applied to a printer, a copy machine, a scanner, a facsimile, or the like.

Figure 2:
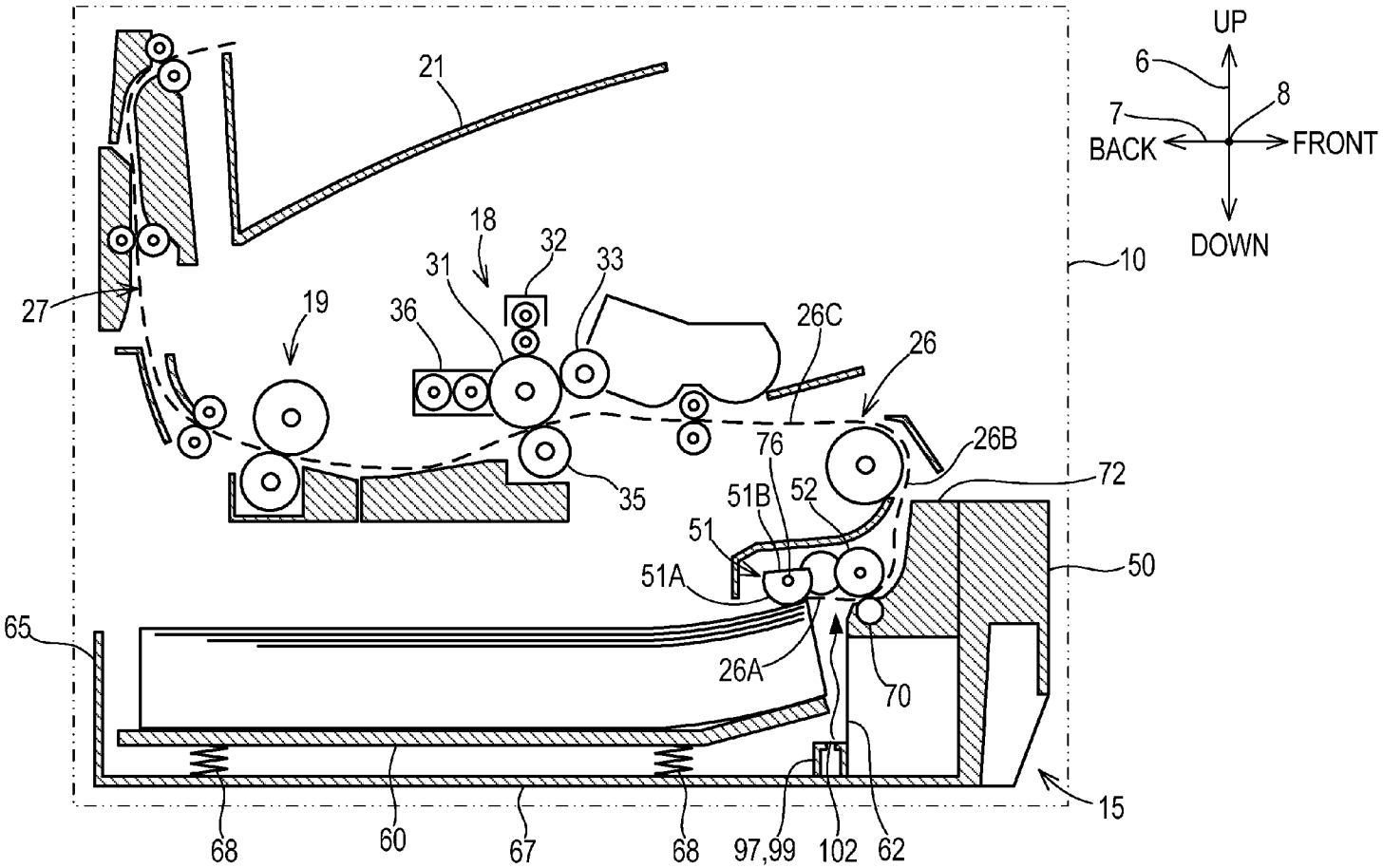
FIG. 2 is a schematic sectional view showing the schematic configuration of the printer shown in FIG. 1.

The printer 10 prints an image on a print sheet based on image data inputted from an external information processing apparatus via a network communication portion (not shown). The print sheet corresponds to a sheet of the present disclosure. As shown in FIGS. 1 and 2, the printer 10 includes an image forming portion 18 of electrophotographic type, a fixing portion 19, a sheet feed apparatus 15, a control portion 80 (see FIG. 6) that performs overall control for the printer 10, and a sheet discharge tray 21. The sheet feed apparatus 15 is an example of a sheet conveyance apparatus of the present disclosure. These components are provided inside a housing 14 forming an outer cover and an inner frame of the printer 10. The housing 14 is an example of a frame of the present disclosure.

The image forming portion 18 transfers a toner image onto a print sheet by using a print material such as a toner. Specifically, as shown in FIG. 2, the image forming portion 18 includes a photosensitive drum 31, a charging portion 32, a developing portion 33, a transfer portion 35, and a cleaning portion 36. The photosensitive drum 31 is charged to have a uniform potential by the charging portion 32. The developing portion 33 develops a toner image on the charged photosensitive drum 31. The toner image is transferred onto a print sheet fed from a sheet feed cassette 50, by the transfer portion 35. The print sheet having the toner image transferred thereon is conveyed to the fixing portion 19 provided on the downstream side (that is, the back side) in the conveyance direction on a conveyance path 27 (indicated by a dashed line in FIG. 2) extending from the image forming portion 18 to the back side. When the print sheet passes through the fixing portion 19, the toner is heated and melted by the fixing portion 19. Thus, the toner image is fixed on the print sheet, and an image is formed on the print sheet. The print sheet having an image formed thereon is conveyed upward through the conveyance path 27 which is curved upward from the fixing portion 19, and then discharged to the sheet discharge tray 21 provided on the upper surface of the printer 10. It is noted that the image forming portion 18 is not limited to an electrophotographic type, but may be an inkjet recording type or may be another recording type or another print type.

Figure 6:
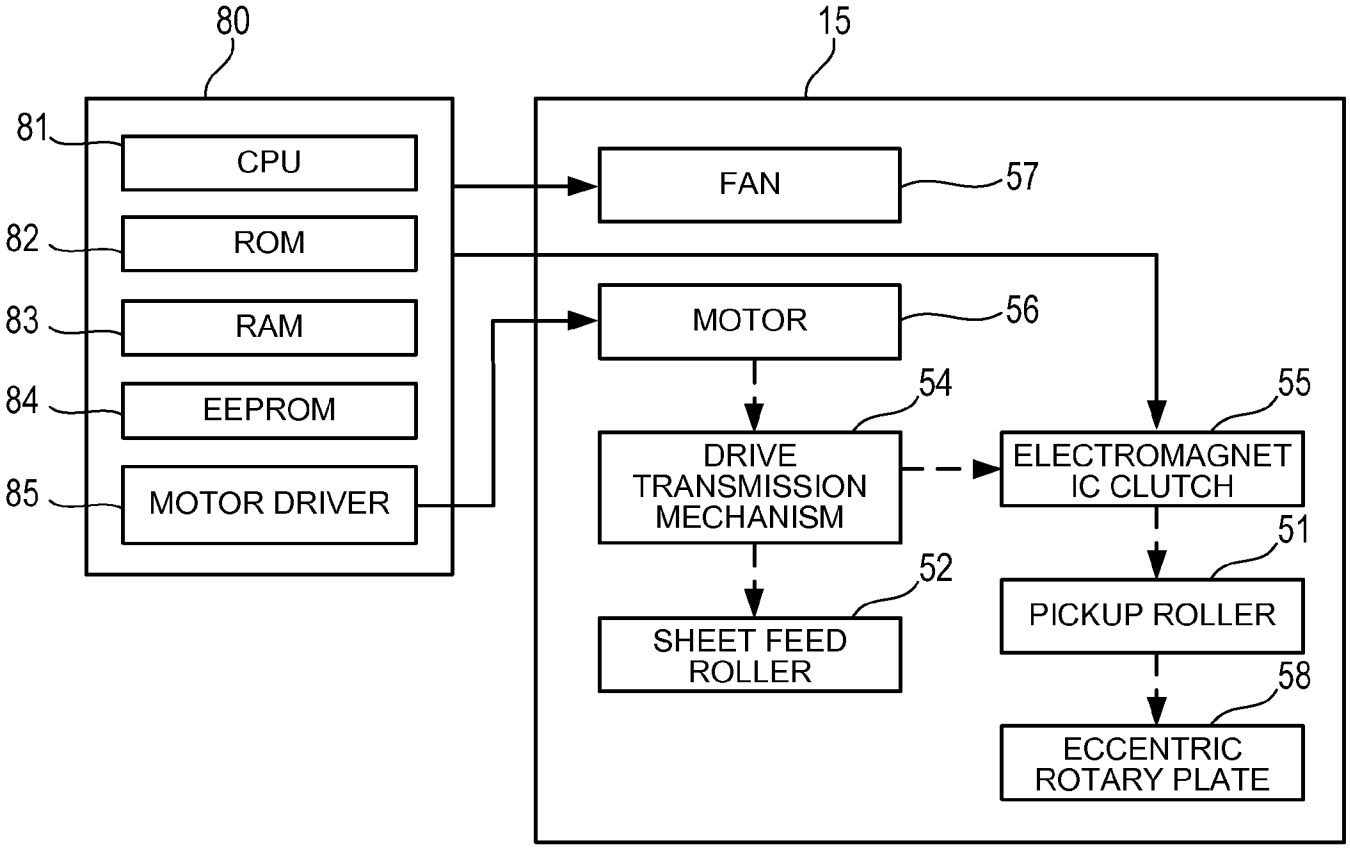
FIG. 6 is a block diagram showing the electric configuration of the printer shown in FIG. 1.

The sheet feed apparatus 15 is provided at the lowermost portion of the printer 10. The sheet feed apparatus 15 includes the sheet feed cassette 50, a pickup roller 51, and a sheet feed roller 52. In addition, as shown in FIG. 6, the sheet feed apparatus 15 includes a motor 56, a fan 57, a drive transmission mechanism 54, an electromagnetic clutch 55, and an eccentric rotary plate 58. The pickup roller 51 is an example of a feeding portion of the present disclosure. The sheet feed roller 52 is an example of a conveyance portion of the present disclosure. The fan 57 is an example of a blower fan of the present disclosure. The eccentric rotary plate 58 is an example of a shutter of the present disclosure. The sheet feed cassette 50 is an example of a sheet stack portion of the present disclosure.

In the sheet feed cassette 50, print sheets on which an image is to be formed by the image forming portion 18 are stacked. The sheet feed cassette 50 is supported by the housing 14. In detail, the sheet feed cassette 50 is supported by a well-known rail supporting mechanism in a slidable manner such that the sheet feed cassette 50 can be inserted in the front-back direction 7 into the housing 14 from the front side of the printer 10 or pulled therefrom. For example, the rail supporting mechanism is composed of a supporting rail provided on the housing 14 and a supported portion that is supported by the supporting rail so as to be slidable along the supporting rail.

Figure 3:
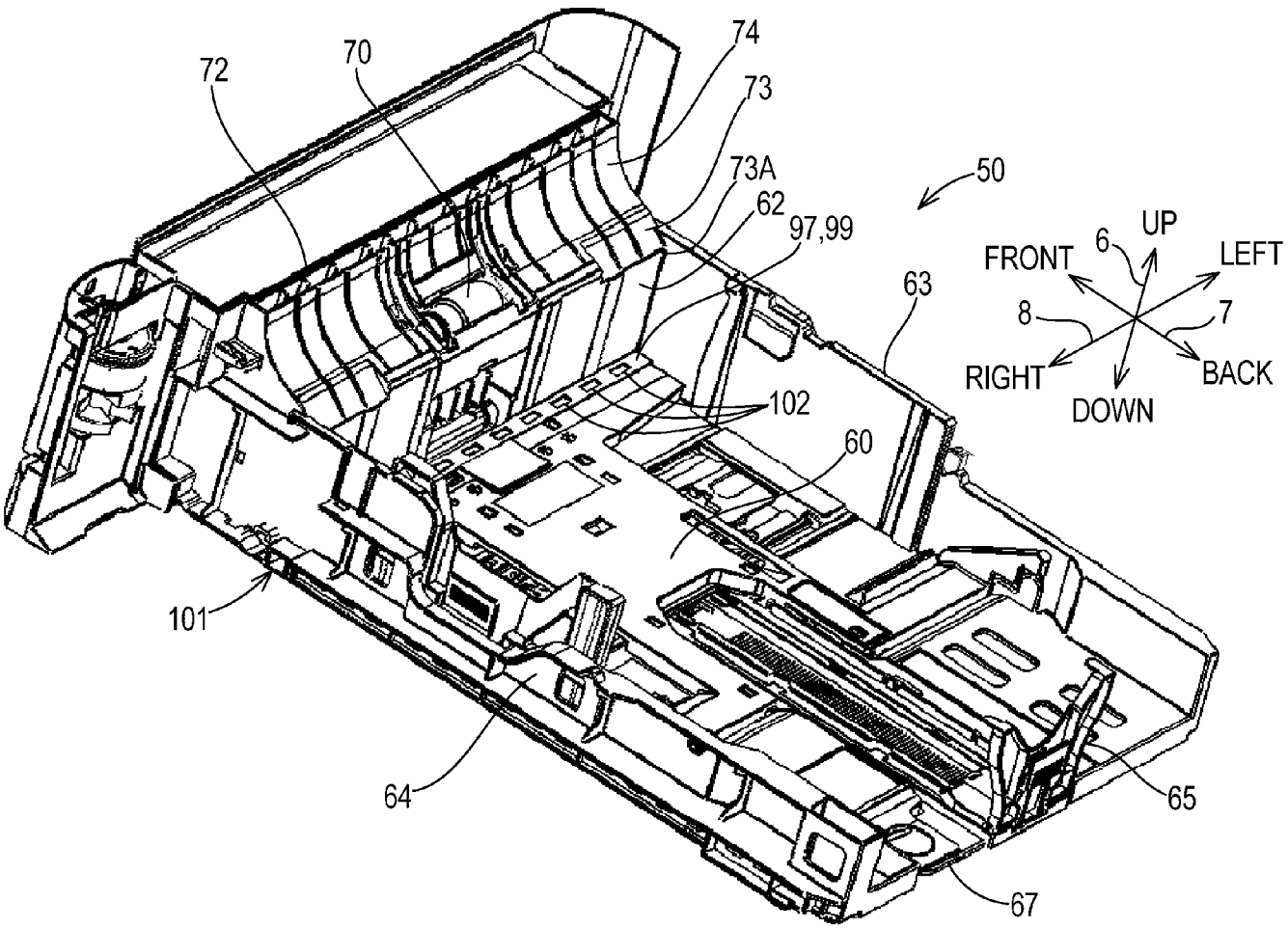
FIG. 3 is a perspective view showing the configuration of a sheet feed cassette shown in FIG. 1.

As shown in FIGS. 2 and 3, the sheet feed cassette 50 has a front wall 62 on the front side, side walls 63 and 64 at the left and the right, and a regulation guide 65 that regulates movement of a paper sheet on the back side. The sheet feed cassette 50 is formed substantially in a rectangular shape. A paper sheet stacking plate 60 on which a plurality of print sheets are stacked is provided inside the sheet feed cassette 50. The paper sheet stacking plate 60 is an example of a sheet stacking plate of the present disclosure. As shown in FIG. 2, the paper sheet stacking plate 60 is attached on an upper surface of a bottom plate 67 of the sheet feed cassette 50 via a plurality of elastic members 68. The elastic member 68 is, for example, a compression coil spring. The paper sheet stacking plate 60 is constantly energized upward by the elastic members 68. Thus, even in the state in which print sheets are stacked on the paper sheet stacking plate 60, an uppermost print sheet is always positioned at a feeding position P1 (see FIG. 4B) where the print sheet can be fed by a contact portion 51A of the pickup roller 51. That is, irrespective of the number of stacked sheets, print sheets stacked on the paper sheet stacking plate 60 are always fed from the constant feeding position P1 by the pickup roller 51. The mechanism that energizes the paper sheet stacking plate 60 upward is not limited to the elastic member 68, but may be a mechanism that lifts the paper sheet stacking plate 60 upward by a driving force of a motor, for example. It is noted that when a non-contact portion 51B of the pickup roller 51 faces to a print sheet, upward movement of the paper sheet stacking plate 60 is regulated by a stopper (not shown). Thus, the non-contact portion 51B of the pickup roller 51 does not contact a print sheet on the paper sheet stacking plate 60.

Figure 4A:
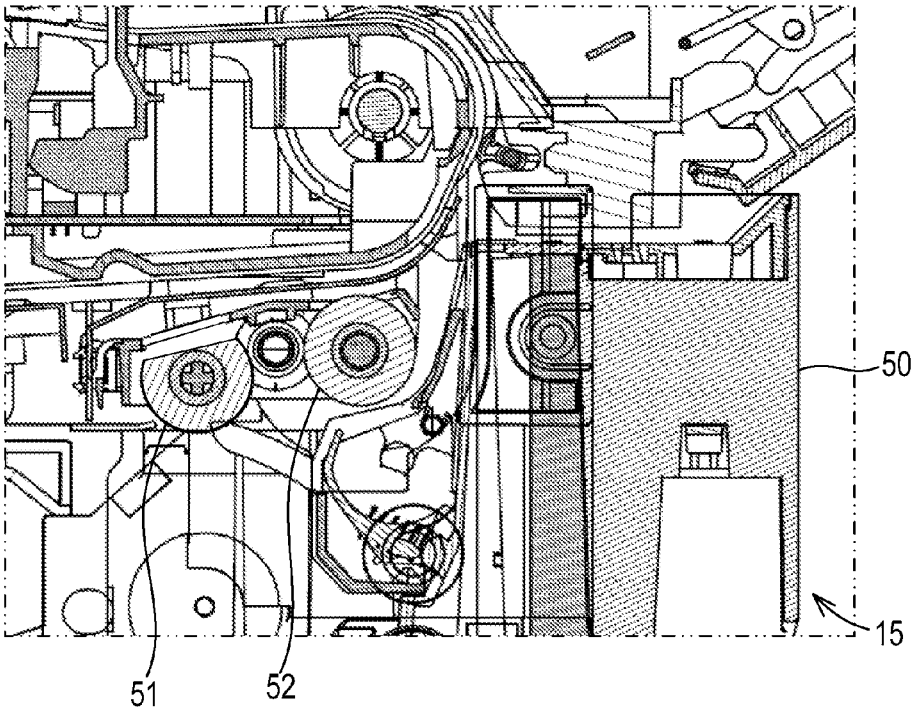
FIG. 4A is a sectional view showing the sectional configuration of a specific part IV in FIG. 1.
Figure 4B:
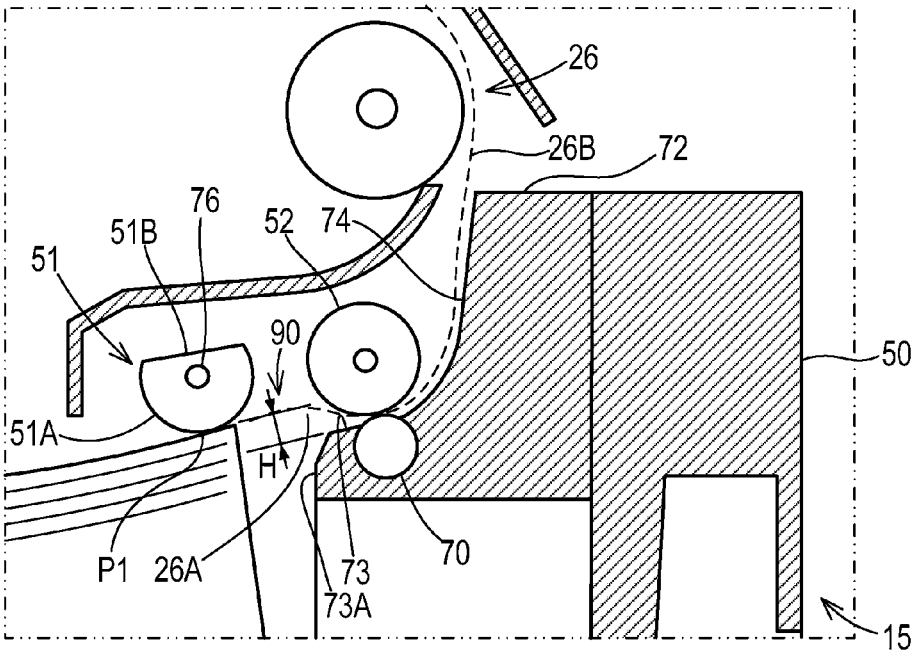
FIG. 4B is a schematic sectional view showing the sectional configuration of the specific part IV in FIG. 1.

As shown in FIG. 2, the pickup roller 51 is provided in the vicinity of the sheet feed cassette 50. In detail, the pickup roller 51 is provided on the front side above the sheet feed cassette 50. The pickup roller 51 is a rotary body that is rotationally driven by a driving force supplied from the motor 56 (see FIG. 6). A rotation shaft 76 of the pickup roller 51 is supported in a rotatable manner by side frames 91 and 92 (see FIG. 9) positioned on the left side and the right side of the housing 14. As shown in FIGS. 4A and 4B, the pickup roller 51 has the contact portion 51A and the non-contact portion 51B. The contact portion 51A contacts a print sheet stacked on the paper sheet stacking plate 60, thereby allowing the print sheet to be fed. The non-contact portion 51B is distant from a print sheet stacked on the paper sheet stacking plate 60. The contact portion 51A is an example of a contact portion of the present disclosure, and the non-contact portion 51B is an example of a non-contact portion of the present disclosure. The pickup roller 51 is obtained by cutting a part of the roller surface of a cylindrical roller member along the axial direction. A portion where the part is cut corresponds to the non-contact portion 51B, and the other arc-shaped portion corresponds to the contact portion 51A. It is noted that instead of the pickup roller 51, a cylindrical rotary body having a rotational axis shifted (decentered) in a radial direction from the central axis may be used. In this rotary body, a portion where the distance from the rotational axis to the outer circumferential surface is long is an example of a contact portion of the present disclosure, and a portion where the distance is short is an example of a non-contact portion of the present disclosure.

Figure 11A:
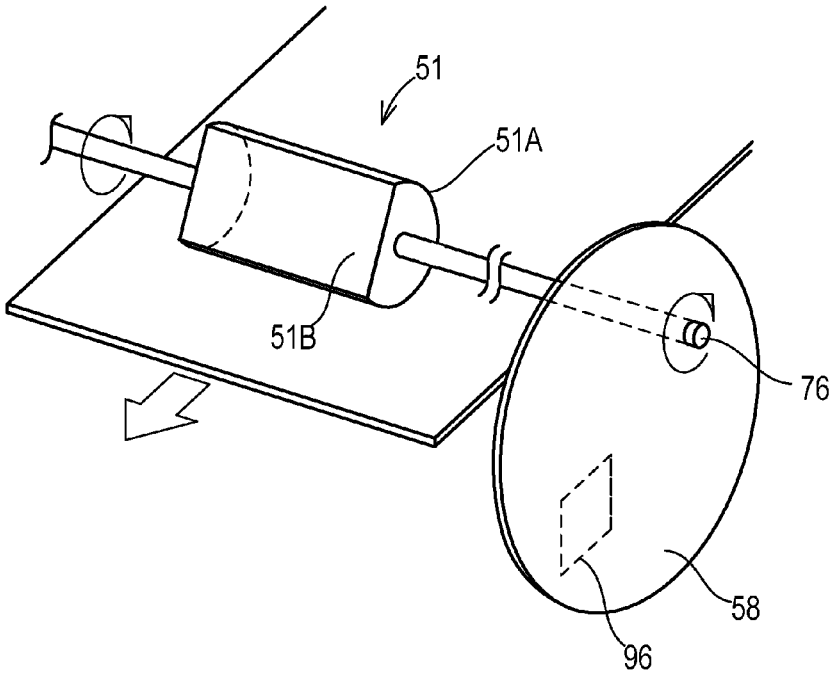
FIG. 11A is a schematic perspective view for explaining the operations of the pickup roller and the eccentric rotary plate.
Figure 11B:
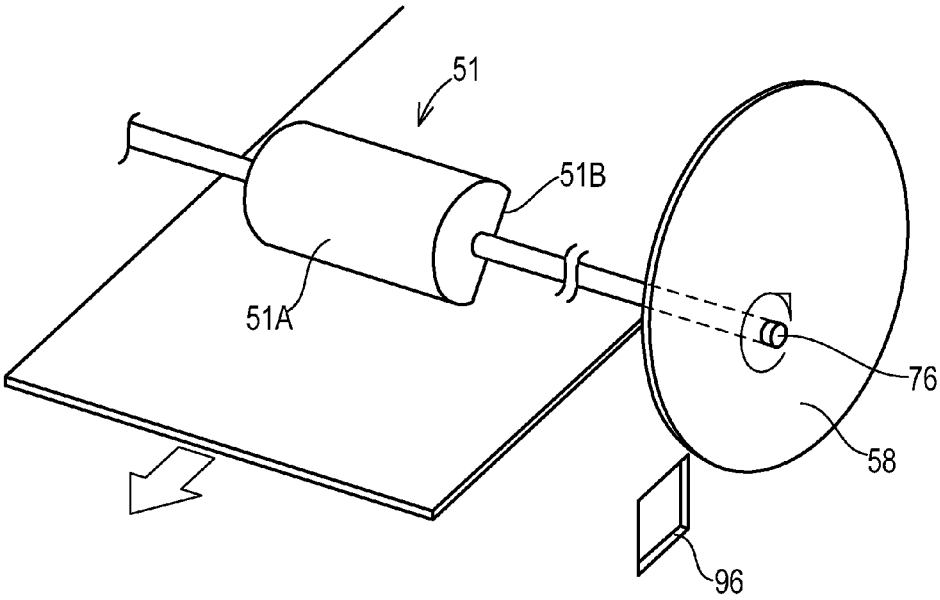
FIG. 11B is a schematic perspective view for explaining the operations of the pickup roller and the eccentric rotary plate.

When a feeding operation for a print sheet is not performed, the pickup roller 51 is stopped in an orientation in which the non-contact portion 51B faces to a print sheet, as shown in FIG. 11B. In this state, when an instruction to start the feeding operation is inputted, the pickup roller 51 is rotationally driven, whereby the contact portion 51A contacts a paper sheet to feed the print sheet, as shown in FIG. 11A. It is noted that the outer circumferential length of the contact portion 51A of the pickup roller 51 corresponds to the distance from the feeding position P1 to a nip portion of the sheet feed roller 52. Therefore, the pickup roller 51 feeds a print sheet by the distance from the feeding position P1 to the nip portion of the sheet feed roller 52.

The sheet feed roller 52 conveys a print sheet fed by the pickup roller 51, downstream in the feeding direction. The sheet feed roller 52 is provided ahead of the pickup roller 51. The sheet feed roller 52 is a rotary body that is rotationally driven by a driving force supplied from the motor 56 (see FIG. 6). A rotation shaft of the sheet feed roller 52 is supported in a rotatable manner by the side frames 91 and 92 (see FIG. 7) positioned on the left side and the right side of the housing 14. The sheet feed roller 52 is a cylindrical rotary body extending in the right-left direction 8. As shown in FIG. 4B, under the sheet feed roller 52, a retard roller 70 is provided which separates multi-fed print sheets by being pressed to the roller surface of the sheet feed roller 52. The retard roller 70 is supported in a rotatable manner by a guide member 72 described later which is provided on the sheet feed cassette 50. When the lead end portion of a print sheet fed by the pickup roller 51 has reached the nip portion between the sheet feed roller 52 and the retard roller 70, the print sheet is held by the sheet feed roller 52 and the retard roller 70, to be further conveyed downstream in the feeding direction.

A print sheet conveyed by the sheet feed roller 52 is conveyed to the image forming portion 18 through a conveyance path 26 formed inside the printer 10. As shown in FIG. 2, the conveyance path 26 includes a lower-side straight path 26A, a curved path 26B, and an upper-side straight path 26C. The lower-side straight path 26A is a path almost linearly extending forward from the feeding position P1 (see FIG. 4B). The curved path 26B is a path having a curved shape, which is curved upward from the nip portion between the sheet feed roller 52 and the retard roller 70 and further curved backward. The upper-side straight path 26C is a linear path extending toward the image forming portion 18. The curved path 26B is an example of a sheet conveyance path of the present disclosure.

As shown in FIG. 4B, the guide member 72 is provided on the outer side of a path from the lower-side straight path 26A to the curved path 26B. The guide member 72 is an example of a conveyance guide member of the present disclosure. The guide member 72 is fixed on the sheet feed cassette 50, and specifically, attached on the upper portion of the front wall 62 of the sheet feed cassette 50. The guide member 72 includes a straight guide portion 73 forming a guide surface on the outer side of the lower-side straight path 26A, and a curved guide portion 74 forming a guide surface on the outer side of the curved path 26B. A print sheet taken out from the paper sheet stacking plate 60 by the pickup roller 51 is fed from the feeding position P1 toward the straight guide portion 73 of the guide member 72. Then, when the print sheet has reached the straight guide portion 73, the lead end portion of the print sheet is guided to the sheet feed roller 52 positioned further ahead (downstream in the feeding direction), with the lower surface of the print sheet being supported by the straight guide portion 73.

As shown in FIG. 4B, a gap 90 is formed between the pickup roller 51 and a back end portion 73A of the guide member 72. In addition, the straight guide portion 73 is provided at a position slightly lower than the feeding position P1. That is, there is a height difference H in the up-down direction 6 between the feeding position P1 and the straight guide portion 73. Since there is such a height difference H, the lead end portion of a print sheet fed from the feeding position P1 is prevented from colliding with the back end portion of the straight guide portion 73, and is smoothly guided onto the upper surface of the straight guide portion 73.

Figure 5A:
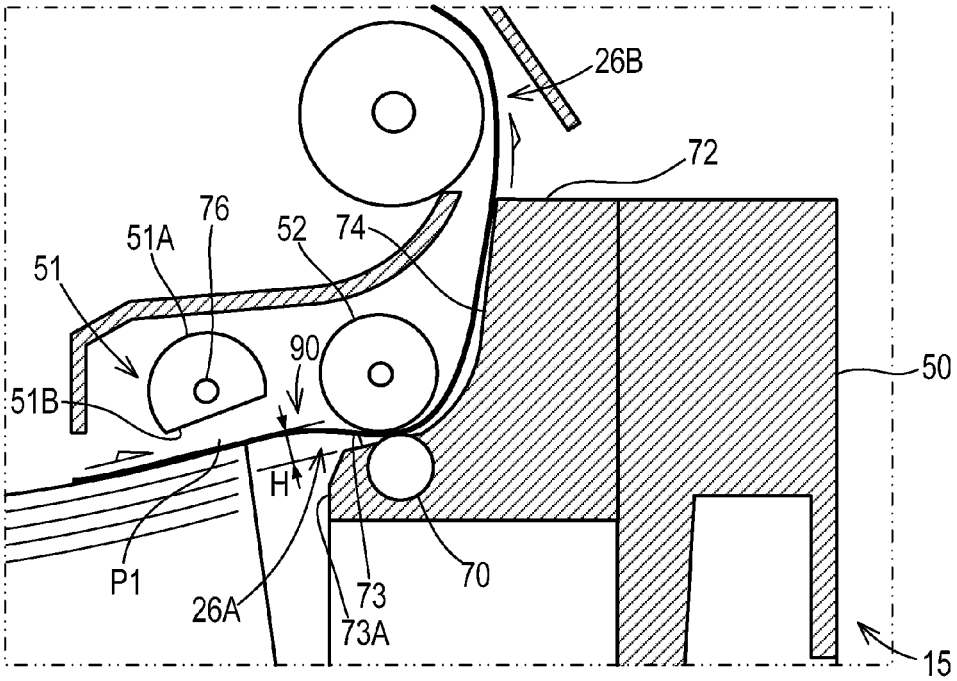
FIG. 5A is a schematic diagram showing the rear end portion of a print sheet being fed in the sheet feed cassette shown in FIG. 1.
Figure 5B:
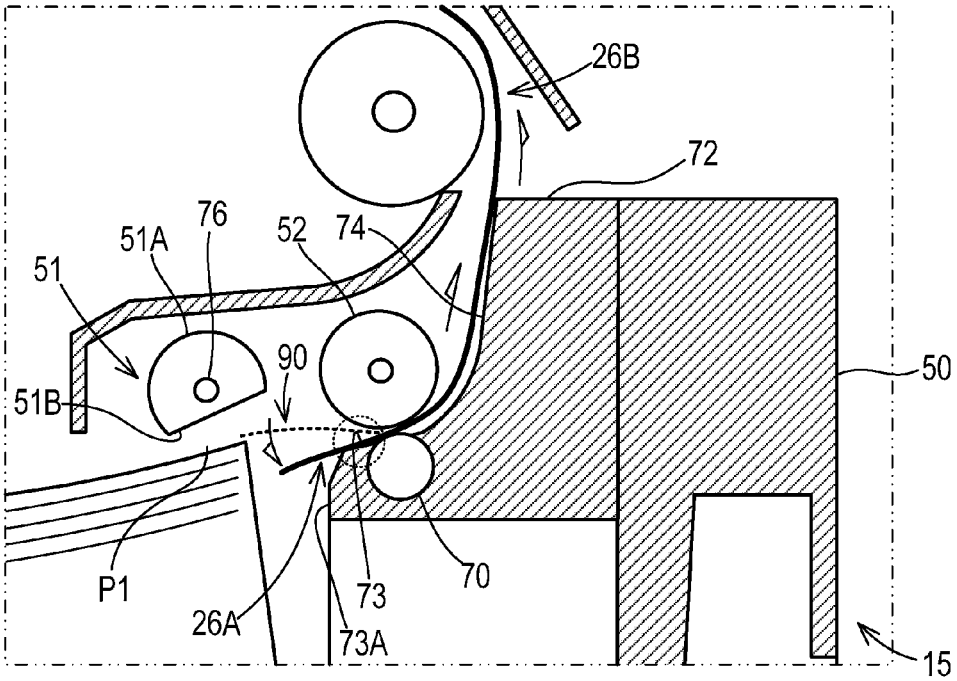
FIG. 5B is a schematic diagram showing the rear end portion of a print sheet being fed in the sheet feed cassette shown in FIG. 1.

In such a structure in which the height difference H is provided between the feeding position P1 and the straight guide portion 73, a sound occurs when the rear end portion of a print sheet passes through the feeding position P1 and contacts the straight guide portion 73. Specifically, as shown in FIGS. 5A and 5B, when the rear end portion of a print sheet passes through the feeding position P1, the rear end portion of the print sheet drops from the feeding position P1 to the straight guide portion 73 to collide with the upper surface of the straight guide portion 73, whereby a collision sound occurs. Particularly, in the case where a print sheet is conveyed being bent by the curved path 26B as in the present embodiment, since the print sheet is bent along the curved path 26B, the orientation of the rear end portion of the print sheet is rapidly changed from the feeding position P1 to the straight guide portion 73, whereby a large collision sound occurs. In order to reduce the collision sound, in the printer 10 of the present embodiment, a blower mechanism that blows air toward the rear end portion of a print sheet from thereunder when the rear end portion of the print sheet passes through the feeding position P1 is provided. The blower mechanism will be described later.

Figure 7:
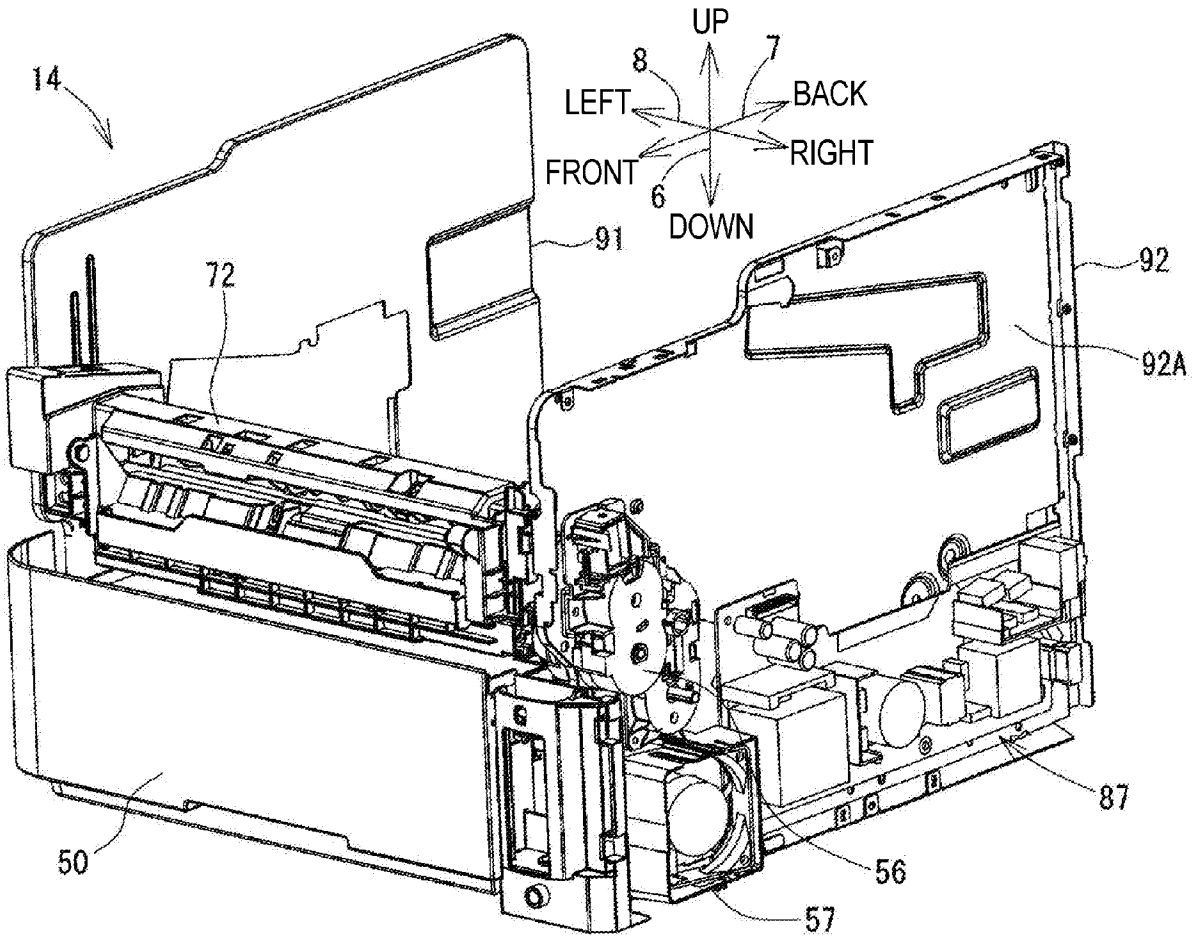
FIG. 7 is a perspective view showing the frame structure of a housing of the printer shown in FIG. 1.

The control portion 80 performs overall control for the printer 10. As shown in FIG. 6, the control portion 80 is composed of a CPU 81, a ROM 82, a RAM 83, an EEPROM 84, a motor driver 85, and the like. The control portion 80 is mounted on a control board 87 (see FIG. 7), together with other electronic devices such as a capacitor, a coil, and a DC/DC converter. In the present embodiment, as shown in FIG. 7, the control board 87 is attached, comparatively near the back side, on the lower end portion of an outer side surface 92A of the side frame 92 of the housing 14.

The control portion 80 is electrically connected to electric devices such as the motor 56, the fan 57, and the electromagnetic clutch 55 of the sheet feed apparatus 15, via an internal bus, a signal line, or the like. In addition, the control portion 80 performs drive control in accordance with a flowchart shown in FIG. 10. The drive control is performed for taking out and feeding, one by one, print sheets stacked on the paper sheet stacking plate 60. A control program for performing the drive control is stored in the ROM 82. By the control program being executed by the CPU 81, the drive control is performed to control the operation of the printer 10. The control portion 80 may be formed by an electronic circuit such as an integrated circuit (ASIC, DSP). The control portion 80 performing the drive control is an example of a rotation control portion of the present disclosure.

The motor 56 is an example of a drive source of the present disclosure, and is a DC motor, for example. The motor 56 supplies a driving force that rotationally drives the pickup roller 51 and the sheet feed roller 52. As shown in FIG. 6, the motor 56 is connected to the motor driver 85 of the control portion 80, and drive-controlled by the motor driver 85. In the present embodiment, as shown in FIG. 7, the motor 56 is attached on the outer side surface 92A of the side frame 92 of the housing 14. In the present embodiment, an example where the pickup roller 51 and the sheet feed roller 52 are rotationally driven by the motor 56 will be described. However, a mechanism in which respective driving forces are separately supplied to the pickup roller 51 and the sheet feed roller 52 by using a plurality of motors, may be employed.

The drive transmission mechanism 54 transmits a driving force from the motor 56 to the sheet feed roller 52 and the pickup roller 51. The drive transmission mechanism 54 may be a gear transmission mechanism composed of a shaft coupling, a gear, and the like, a belt transmission mechanism composed of a belt, a pulley, and the like, or a wire transmission mechanism composed of a wire, a pulley, and the like, for example.

The electromagnetic clutch 55 is a clutch to be turned on or off in accordance with an instruction signal from the control portion 80. The electromagnetic clutch 55 transmits a driving force from the drive transmission mechanism 54 to the pickup roller 51. When the electromagnetic clutch 55 is turned on, the driving force from the drive transmission mechanism 54 is transmitted to the pickup roller 51, and when the electromagnetic clutch 55 is turned off, drive transmission from the drive transmission mechanism 54 to the pickup roller 51 is stopped. As the electromagnetic clutch 55, for example, a step clutch may be used which is turned on when an instruction signal is inputted and then turned off when a driving force that causes rotation by a predetermined set rotation amount has been transmitted. By using the step clutch, rotational driving of the pickup roller 51 can be controlled by only outputting an instruction signal without feedback control, and in addition, the pickup roller 51 can be controlled so as to stop at any rotational angle position. In the present embodiment, the set rotation amount is set at a rotation amount (i.e., 360°) corresponding to one revolution of the pickup roller 51.

The fan 57 sends air by taking in air and blowing the air. The fan 57 is used for blowing air to the control board 87 which is an example of a heat source of the printer 10, thereby cooling the control board 87, and for blowing air into the sheet feed cassette 50, thereby reducing a sound caused upon feeding of a print sheet. In the present embodiment, as shown in FIG. 7, the fan 57 is attached on the front side at the lower end portion of the outer side surface 92A of the side frame 92 of the housing 14. That is, the fan 57 is arranged together with the control board 87 in the front-back direction.

Figure 8:
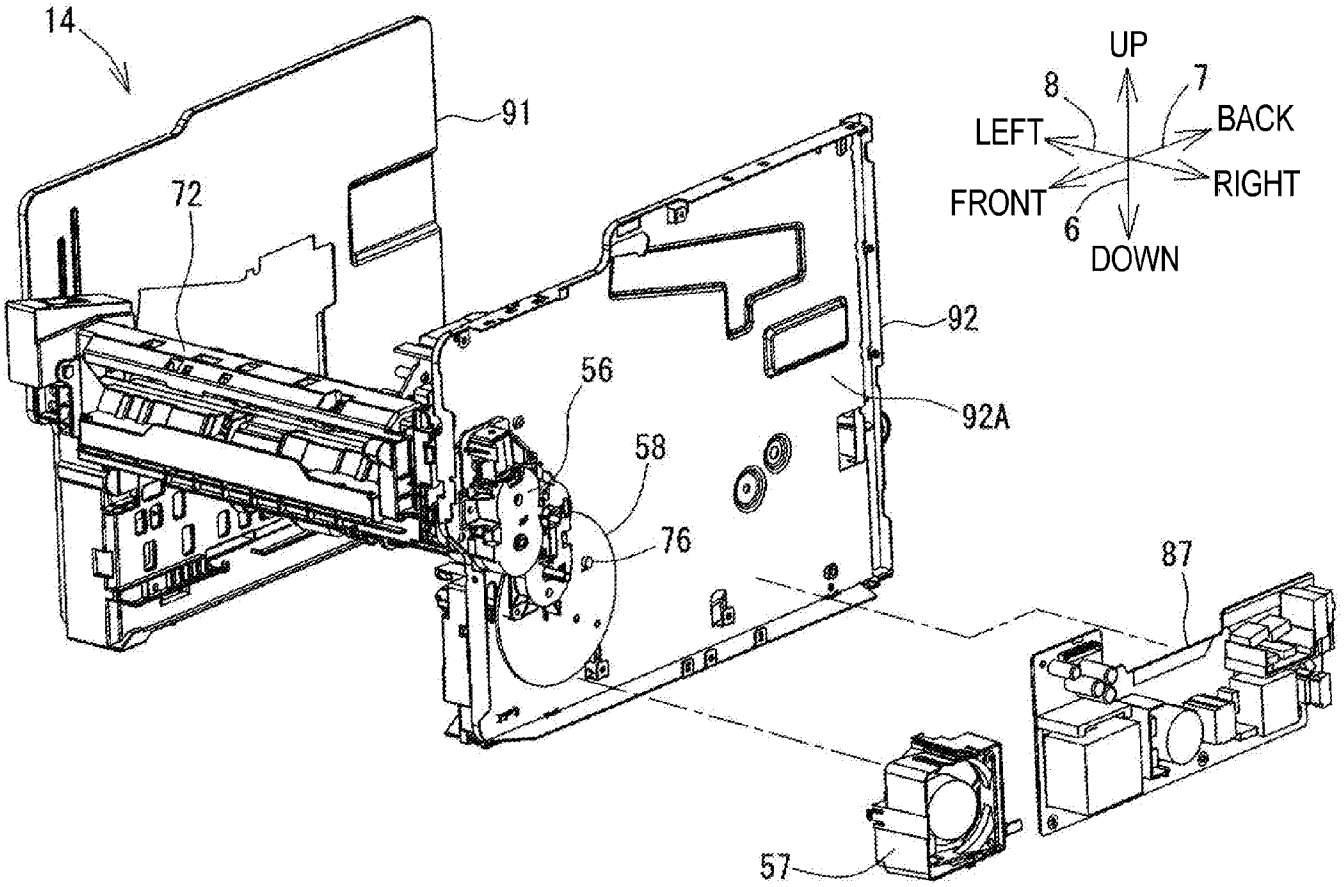
FIG. 8 is a perspective view showing the state in which a control board and a fan are detached from the housing of the printer shown in FIG. 1.

The eccentric rotary plate 58 opens or closes an air hole 96 through which air is sent from the fan 57 into the sheet feed cassette 50. The air hole 96 is an example of an air hole of the present disclosure. The position of the eccentric rotary plate 58 can be changed between an open position (position shown in FIG. 11B) that opens the air hole 96 and a close position (position shown in FIG. 11A) that closes the air hole 96. The open position is an example of a first position of the present disclosure. The close position is an example of a second position of the present disclosure. As shown in FIG. 8, the eccentric rotary plate 58 is attached on the outer side surface 92A of the side frame 92 of the housing 14. In detail, the eccentric rotary plate 58 is supported in a rotatable manner by the side frame 92, and fixed on the rotation shaft 76 of the pickup roller 51 which penetrates through the side frame 92 to the outer side surface 92A. Therefore, the pickup roller 51 and the eccentric rotary plate 58 rotate in synchronization with each other. In addition, the rotation amount of the pickup roller 51 and the rotation amount of the eccentric rotary plate 58 are always equal to each other. The eccentric rotary plate 58 is a disk-like member formed by a thin plate material, and the rotation shaft 76 is fixed at a position (decentered position) shifted from the center of the eccentric rotary plate 58.

In the present embodiment, the pickup roller 51 and the eccentric rotary plate 58 are linked with each other so as to have the following positional relationship. That is, as shown in FIG. 11A, the eccentric rotary plate 58 has the close position when a print sheet on the paper sheet stacking plate 60 is fed by the contact portion 51A of the pickup roller 51. That is, during the feeding by the contact portion 51A of the pickup roller 51, the eccentric rotary plate 58 keeps closing the air hole 96. On the other hand, as shown in FIG. 11B, the eccentric rotary plate 58 has the open position when the non-contact portion 51B of the pickup roller 51 stops at a position facing to a print sheet on the paper sheet stacking plate 60. That is, the eccentric rotary plate 58 opens the air hole 96.

Figure 9:
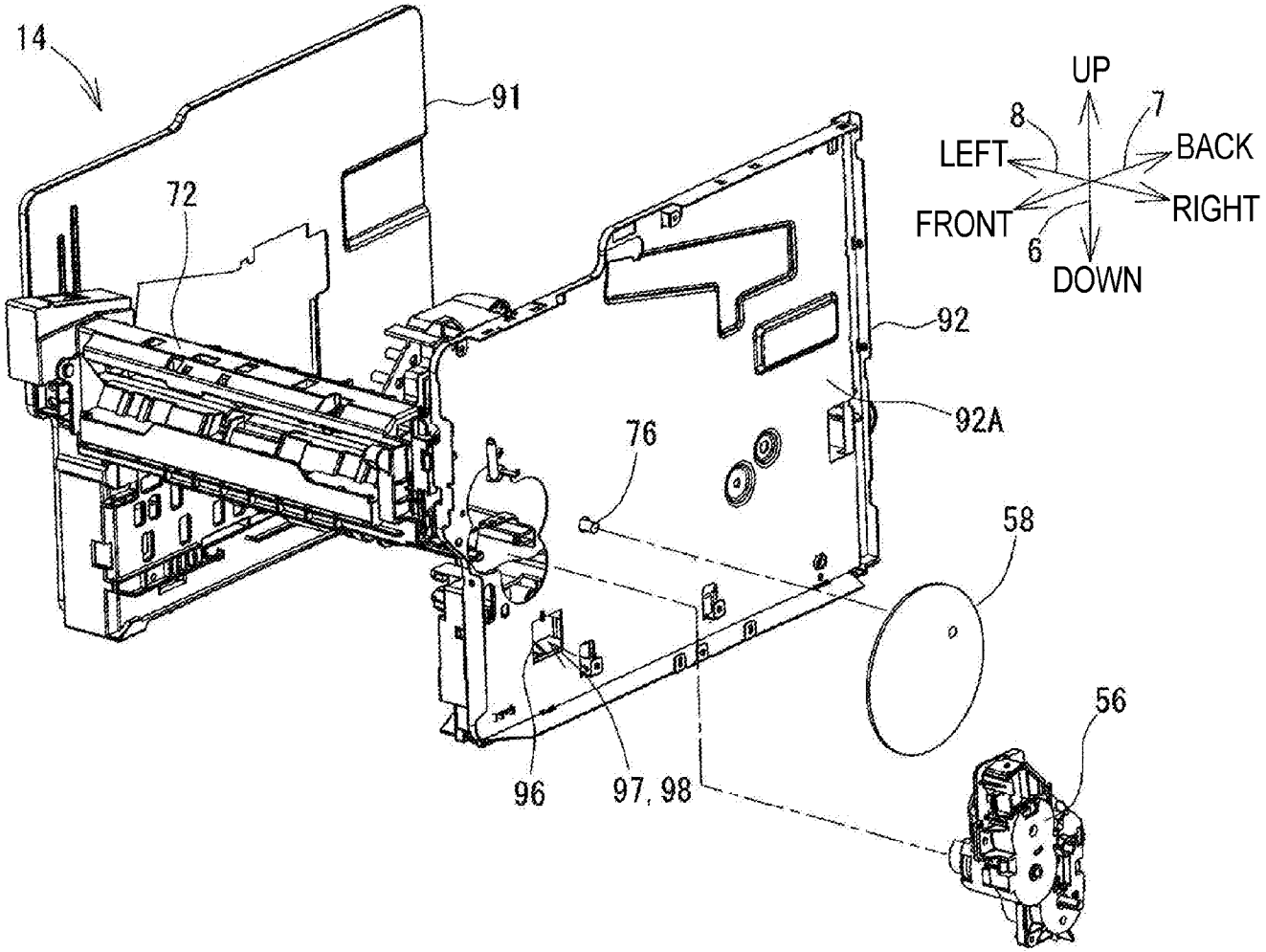
FIG. 9 is a perspective view showing the state in which a motor and an eccentric rotary plate are detached from the housing of the printer shown in FIG. 1.

As shown in FIG. 9, the air hole 96 is formed in the side frame 92. The air hole 96 is formed at a position corresponding to the air outlet of the fan 57 from which air is blown. A small gap is provided between the air outlet and the air hole 96, and the eccentric rotary plate 58 is provided so as to be operable in the gap.

Air flowing into the air hole 96 is sent into the sheet feed cassette 50 through an air duct 97 formed in the housing 14 and the sheet feed cassette 50. The air duct 97 is an example of an air duct of the present disclosure. The air duct 97 blows air blown from the air outlet of the fan 57, toward the gap 90. The blown air is guided from the lower side to the upper side in the vicinity of the back end portion 73A, to proceed to the back end portion 73A of the straight guide portion 73, and then the air is blown to a conveyance path between the feeding position P1 and the back end portion 73A. The air duct 97 is composed of a bypass duct 98 (see FIG. 9) provided in the side frame 92, and an internal duct 99 (see FIG. 3) provided in the sheet feed cassette 50. In the state in which the sheet feed cassette 50 is attached into the housing 14, the bypass duct 98 leads from the air hole 96 to the inner side surface of the side frame 92, and then is connected to an opening 101 formed on the side wall 64 of the sheet feed cassette 50. As shown in FIG. 3, the internal duct 99 extends from the opening 101 in the right-left direction 8 on the upper surface of the bottom plate 67. On the upper surface of the internal duct 99, a plurality of blowing openings 102 are formed being arranged in the right-left direction 8. As shown in FIG. 2, the internal duct 99 is provided directly under the back end portion 73A of the straight guide portion 73. Air passing through the internal duct 99 is blown upward from the blowing openings 102.

Figure 10:
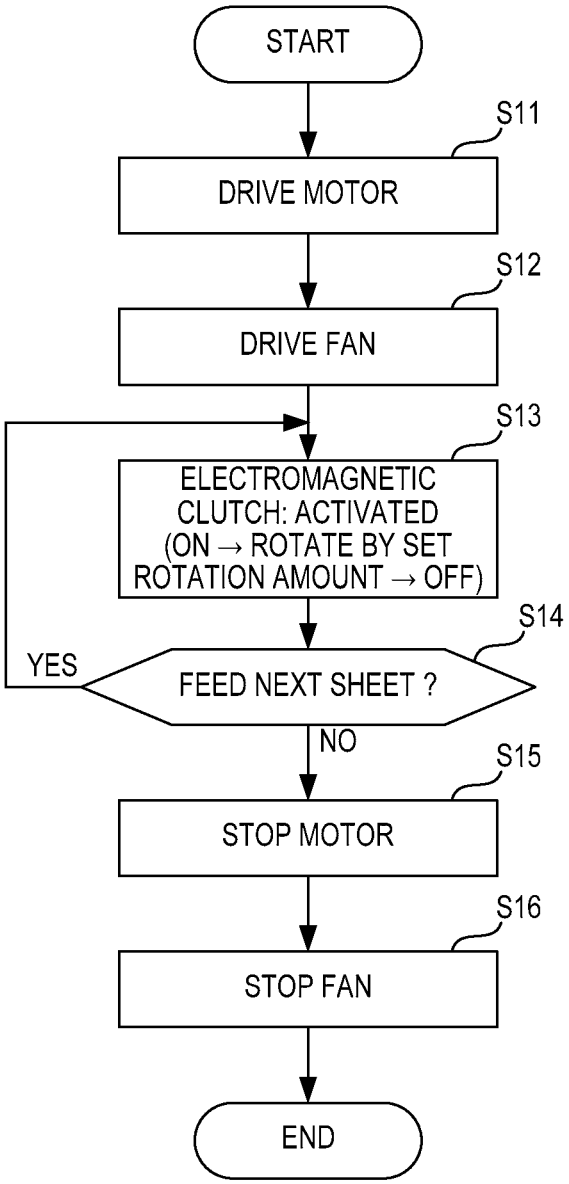
FIG. 10 is a flowchart showing an example of the procedure of drive control for a pickup roller and a sheet feed roller, executed by a control portion of the printer shown in FIG. 1.

Hereinafter, with reference to the flowchart shown in FIG. 10 and the operation explanation diagrams shown in FIGS. 11A and 11B, the procedure of the drive control for the motor 56 upon feeding of a print sheet, executed by the control portion 80, will be described. S11, S12, . . . , in FIG. 10 represent the numbers of steps in the processing procedure. Each step is executed by the control portion 80 in accordance with the procedure, whereby feeding operation for a print sheet and open-close operation for the air hole 96 by the eccentric rotary plate 58 can be realized. Here, the open-close operation refers to open-close operation of changing the eccentric rotary plate 58 from the close position to the open position when the rear end portion of a fed print sheet passes through the feeding position P1 (see FIG. 4B). Components (the control portion 80, the motor 56, the pickup roller 51, the electromagnetic clutch 55, and the like) for realizing the open-close operation are an example of a blowing control portion of the present disclosure.

When the printer 10 is not performing feeding operation, as shown in FIG. 11B, the pickup roller 51 stops in an orientation in which the non-contact portion 51B faces to a print sheet on the paper sheet stacking plate 60. When an instruction signal for stating image forming operation is inputted to the printer 10, the control portion 80 instructs the motor driver 85 to rotationally drive the motor 56 (S11). As a result, a driving force of the motor 56 is transmitted to the sheet feed roller 52 via the drive transmission mechanism 54, whereby the sheet feed roller 52 is rotated. Then, at the same time as the rotational driving of the motor 56, the control portion 80 drives the fan 57 which has stopped, to blow air by the fan 57 (S12). Further, the control portion 80 outputs an ON signal for activating the electromagnetic clutch 55, thereby activating the electromagnetic clutch 55 (S13). As a result, the driving force of the motor 56 is transmitted from the drive transmission mechanism 54 to the pickup roller 51 via the electromagnetic clutch 55, whereby the pickup roller 51 is rotated.

When the pickup roller 51 is rotated and the contact portion 51A contacts a print sheet on the paper sheet stacking plate 60, the uppermost print sheet is taken out and the print sheet is fed from the feeding position P1. At this time, the position of the eccentric rotary plate 58 becomes the close position and keeps closing the air hole 96 until the lead end portion of the print sheet is fed through the straight guide portion 73 and reaches the nip portion between the sheet feed roller 52 and the retard roller 70 (see FIG. 11A). Therefore, even if the fan 57 is driven, since the air hole 96 is closed, air blown from the fan 57 is sent to the control board 87 without flowing into the air duct 97. It is noted that air is not blown from the blowing openings 102 until the lead end portion of the print sheet is fed to reach the nip portion between the sheet feed roller 52 and the retard roller 70. Therefore, the lead end portion of the print sheet is prevented from becoming unstable due to influence of air flow, so that the lead end portion of the print sheet is smoothly fed to the straight guide portion 73.

Then, when the lead end portion of the print sheet has reached the nip portion between the sheet feed roller 52 and the retard roller 70, print conveyance by the sheet feed roller 52 is started. Thereafter, the contact between the contact portion 51A and the print sheet is ended and then the non-contact portion 51B faces to the print sheet. As described above, since the set rotation amount of the electromagnetic clutch 55 is one revolution (360°), the pickup roller 51 rotates by one revolution and then stops in the original orientation shown in FIG. 11B. At this time, the position of the eccentric rotary plate 58 becomes the open position (see FIG. 11B). Therefore, since the air hole 96 is opened, a part of air blown from the fan 57 flows into the air hole 96 of the air duct 97, and the rest of the air is sent to the control board 87. The air flowing into the air hole 96 is blown upward from the blowing openings 102 of the internal duct 99. This air blowing continues at least until the rear end portion of the print sheet reaches the straight guide portion 73. Thus, air flows from the blowing openings 102 upward to the back end portion 73A of the straight guide portion 73, whereby the air is blown to the rear end portion of the print sheet having passed through the feeding position P1.

In step S14, if the control portion 80 has determined that an instruction to feed the next print sheet has been given, the control portion 80 repeats the processing from step S13. On the other hand, if the control portion 80 has determined that no instruction to feed the next print sheet has been given, the control portion 80 stops the motor 56 (S15), and further, after a certain time has elapsed, stops the fan 57 (S16).

Owing to such a configuration of the printer 10, air is not blown from the blowing openings 102 until a print sheet fed from the paper sheet stacking plate 60 reaches the nip portion between the sheet feed roller 52 and the retard roller 70. Therefore, the lead end portion of the print sheet is smoothly fed to the nip portion between the sheet feed roller 52 and the retard roller 70. In addition, after the lead end portion of the print sheet has reached the straight guide portion 73, air is blown from the blowing openings 102. This air blowing continues until the rear end portion of the print sheet departs from the feeding position P1, passes through the straight guide portion 73, and reaches the nip portion. Therefore, even when the orientation of the rear end portion of the print sheet is to be rapidly changed downward immediately after the rear end portion has passed through the feeding position P1, air from the blowing openings 102 acts to orient the print sheet upward. Thus, the rear end portion of the print sheet is prevented from rapidly colliding with the straight guide portion 73, whereby occurrence of a collision sound between the rear end portion of the print sheet and the straight guide portion 73 is suppressed.

In the above embodiment, an example where a print sheet is fed to the curved conveyance path 26 has been described. However, also in the case where a print sheet is fed by the sheet feed roller 52 without being bent, occurrence of a sound due to the rear end portion of the print sheet can be suppressed. In the above embodiment, an example where the eccentric rotary plate 58 is used has been described. However, a disk-like rotary plate on which the rotation shaft 76 is fixed at the center thereof may be used. In this case, it is conceivable that an opening is formed on the rotary plate at a position corresponding to the air hole 96 so that the opening is positioned at the air hole 96 when the rotary plate is in the open position.

As the shutter of the present disclosure, a valve member or a shutter member that opens or closes the air hole 96 may be provided and operated by an electric device such as a solenoid. In this case, the control portion 80 may determine a timing at which the rear end portion of a print sheet passes through the feeding position P1, based on the output value of a sensor or the conveyed amount of the print sheet, and open the air hole 96 only at the pass timing.

The present disclosure is not limited to an example where a print sheet is fed from the sheet feed cassette 50 to the image forming portion. For example, in the case where an image reading apparatus such as a scanner or a multifunction peripheral including such an image reading apparatus has an automatic document reading function, the present disclosure is also applicable to the configuration in which document sheets placed on a document sheet tray are taken out one by one to be fed to the image reading position. Instead of the printer 10, the present disclosure is also applicable to a sheet feed apparatus separated from the printer 10.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveyance apparatus comprising:

a frame;

a sheet stack portion provided inside the frame and allowing a sheet to be stacked in the sheet stack portion;

a sheet stacking plate provided in the sheet stack portion and allowing a sheet to be stacked on the sheet stacking plate;

a feeding portion that feeds a sheet stacked on the sheet stacking plate from a predetermined feeding position;

a conveyance portion that is provided on a downstream side in a sheet conveyance direction relative to the feeding portion, and conveys the sheet fed from the feeding portion further downstream in the sheet conveyance direction;

a conveyance guide member provided on the downstream side in the sheet conveyance direction relative to the feeding portion and spaced from the feeding portion by a predetermined gap, the conveyance guide member having a guide surface to support a lower surface of the sheet fed by the feeding portion and guide the sheet downstream in the sheet conveyance direction, an end portion of the guide surface on an upstream side in the sheet conveyance direction being positioned lower than the feeding position;

a blower fan attached to the frame;

an air duct that is provided in the sheet stack portion and blows air sent from the blower fan, toward the gap, from a position lower than the gap; and a blowing control portion that controls blowing of air from the air duct, does not cause the air to be blown from the air duct until a lead end of the sheet fed from the feeding position reaches a nip portion of the conveyance portion, and causes the air to be blown from the air duct after the lead end of the sheet reaches the nip portion.

2. The sheet conveyance apparatus according to claim 1, further comprising:

an air hole that opens on the frame and allows the air sent from the blower fan to flow into the air duct through the air hole; and a shutter that opens or closes the air hole, wherein the blowing control portion controls open-close operation of the shutter, thereby controlling the blowing of air from the air duct.

3. The sheet conveyance apparatus according to claim 2, wherein the position of the shutter can be changed between a first position that allows the air hole to be opened and a second position that allows the air hole to be closed, and the blowing control portion changes the shutter from the second position to the first position after the lead end of the sheet fed from the feeding position reaches the nip portion of the conveyance portion.

4. The sheet conveyance apparatus according to claim 3, wherein the conveyance guide member forms a curved sheet conveyance path that guides upward the sheet fed by the feeding portion while bending the sheet.

5. The sheet conveyance apparatus according to claim 4, further comprising a heat source arranged inside or outside the sheet conveyance apparatus, wherein the blower fan is provided to send air to the heat source, and the air duct blows, toward the gap, at least a part of the air blown by the blower fan, when the shutter is in the first position.

6. The sheet conveyance apparatus according to claim 5, wherein the blowing control portion keeps the shutter in the second position until the lead end of the sheet fed from the feeding position reaches the nip portion of the conveyance portion.

7. The sheet conveyance apparatus according to claim 6, wherein the feeding portion is a rotary body to be rotationally driven by a driving force supplied from a drive source, the rotary body having a contact portion that contacts the sheet stacked on the sheet stacking plate to feed the sheet, and a non-contact portion that is distant from the sheet stacked on the sheet stacking plate, the sheet conveyance apparatus further comprising a rotation control portion that rotates the rotary body so as to cause the contact portion to contact the sheet until the lead end portion of the sheet reaches the conveyance portion, and stops the rotary body at a non-contact position where the non-contact portion faces the sheet after the lead end portion of the sheet reaches the conveyance portion, wherein the shutter is joined with a rotation shaft of the rotary body, so that the shutter is in the second position when the rotary body feeds the sheet by the contact portion and is in the first position when the rotary body stops at the non-contact position.

8. The sheet conveyance apparatus according to claim 3, further comprising a heat source arranged inside or outside the sheet conveyance apparatus, wherein the blower fan is provided to send air to the heat source, and the air duct blows, toward the gap, at least a part of the air blown by the blower fan, when the shutter is in the first position.

9. The sheet conveyance apparatus according to claim 1, wherein the conveyance guide member forms a curved sheet conveyance path that guides upward the sheet fed by the feeding portion while bending the sheet.

10. The sheet conveyance apparatus according to claim 1, further comprising:

an air hole that opens on the frame and allows the air sent from the blower fan to flow into the air duct through the air hole; and a shutter that opens or closes the air hole, wherein the blowing control portion controls open-close operation of the shutter, thereby controlling the blowing of air from the air duct.

11. The sheet conveyance apparatus according to claim 10, wherein the position of the shutter can be changed between a first position that allows the air hole to be opened and a second position that allows the air hole to be closed, and the blowing control portion changes the shutter from the second position to the first position after the lead end of the sheet fed from the feeding position reaches the nip portion of the conveyance portion.

12. The sheet conveyance apparatus according to claim 11, wherein the conveyance guide member forms a curved sheet conveyance path that guides upward the sheet fed by the feeding portion while bending the sheet.

13. The sheet conveyance apparatus according to claim 11, wherein the blower fan sends air to a heat source provided either inside or outside the sheet conveyance apparatus, and the air duct blows, toward the gap, at least a part of the air blown by the blower fan, when the shutter is in the first position.

14. The sheet conveyance apparatus according to claim 11, wherein the blowing control portion keeps the shutter in the second position until the lead end of the sheet fed from the feeding position reaches the nip portion of the conveyance portion.

15. The sheet conveyance apparatus according to claim 11, wherein the feeding portion is a rotary body to be rotationally driven by a driving force supplied from a drive source, the rotary body having a contact portion that contacts the sheet stacked on the sheet stacking plate to feed the sheet, and a non-contact portion that is distant from the sheet stacked on the sheet stacking plate, the sheet conveyance apparatus further comprising a rotation control portion that rotates the rotary body so as to cause the contact portion to contact the sheet until the lead end portion of the sheet reaches the conveyance portion, and stops the rotary body at a non-contact position where the non-contact portion faces the sheet after the lead end portion of the sheet reaches the conveyance portion, wherein the shutter is joined with a rotation shaft of the rotary body, so that the shutter is in the second position when the rotary body feeds the sheet by the contact portion and is in the first position when the rotary body stops at the non-contact position.

16. The sheet conveyance apparatus of claim 1, wherein the air is blown to the rear end portion of the print sheet.

17. An image forming apparatus comprising:

an image forming portion for forming images on sheets; and a sheet conveyance apparatus, the sheet conveyance apparatus including:

a frame;

a sheet stack portion provided inside the frame and allowing a sheet to be stacked in the sheet stack portion;

a sheet stacking plate provided in the sheet stack portion and allowing a sheet to be stacked on the sheet stacking plate;

a feeding portion that feeds a sheet stacked on the sheet stacking plate from a predetermined feeding position;

a conveyance portion that is provided on a downstream side in a sheet conveyance direction relative to the feeding portion, and conveys the sheet fed from the feeding portion, further downstream in the sheet conveyance direction;

a conveyance guide member provided on a downstream side in the sheet conveyance direction relative to the feeding portion, and spaced from the feeding portion by a predetermined gap, the conveyance guide member having a guide surface to support a lower surface of the sheet fed by the feeding portion and guide the sheet downstream in the sheet conveyance direction, an end portion of the guide surface on an upstream side in the sheet conveyance direction being positioned lower than the feeding position;

a blower fan attached to the frame;

an air duct that is provided in the sheet stack portion and blows air sent from the blower fan, toward the gap, from a position lower than the gap; and a blowing control portion that controls blowing of air from the air duct, does not cause the air to be blown from the air duct until a lead end of the sheet fed from the feeding position reaches a nip portion of the conveyance portion, and causes the air to be blown from the air duct after the lead end portion of the sheet reaches the nip portion.

* * * * *